US010961759B2

(12) United States Patent
Wang

(10) Patent No.: US 10,961,759 B2
(45) **Date of Patent: *Mar. 30, 2021**

(54) PNEUMATIC DOOR CLOSER

(71) Applicant: CMECH (GUANGZHOU) LTD., Guangdong (CN)

(72) Inventor: Fan Shui Wang, Guangdong (CN)

(73) Assignee: CMECH (GUANGZHOU) LTD., Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/511,318

(22) Filed: Jul. 15, 2019

(65) Prior Publication Data

US 2019/0338576 A1 Nov. 7, 2019

Related U.S. Application Data

(60) Division of application No. 15/702,292, filed on Sep. 12, 2017, now Pat. No. 10,352,079, which is a (Continued)

(30) Foreign Application Priority Data

Feb. 25, 2016 (CN) ..... 201610109458

(51) Int. Cl.
*E05F 3/02* (2006.01)
*E05F 3/12* (2006.01)
(Continued)

(52) U.S. Cl.
CPC ..... *E05F 3/02* (2013.01); *E05F 1/1091* (2013.01); *E05F 3/12* (2013.01); *E05F 3/104* (2013.01);
(Continued)

(58) Field of Classification Search
CPC ... E05F 3/02; E05F 3/12; E05F 1/1091; E05F 3/104; E05F 2003/228
(Continued)

(56) References Cited

U.S. PATENT DOCUMENTS 446,426 A * 2/1891 Bryon ..... F16F 9/3405 188/317
861,546 A 7/1907 Snell
(Continued)

FOREIGN PATENT DOCUMENTS

CN 201106346 Y 8/2008
DE 202010011321 U1 12/2010
(Continued)

OTHER PUBLICATIONS

Ludewig GmbH, "Climber", Installation Instructions, 3 pages, Jul. 2013.

*Primary Examiner* — Jeffrey O'Brien
(74) *Attorney, Agent, or Firm* — McKee, Voorhees & Sease, PLC

(57) ABSTRACT

A pneumatic door closer includes a rotary energy-storing mechanism including a housing and a driving mechanism. The driving mechanism includes a cylinder, a second piston assembly and a sealing element, the sealing element is in an air tight connection with the cylinder and the second piston assembly, to form a closed space filled with high pressure gas in the cylinder. The second piston assembly drives the closed space into a first air chamber and a second air chamber in communication with each other. The driving mechanism also includes a first piston assembly connected to the second piston assembly. The pneumatic door closer also includes a transmission mechanism having one end received in the housing and another end connected to the door frame.

10 Claims, 5 Drawing Sheets

Related U.S. Application Data continuation of application No. 15/211,098, filed on Jul. 15, 2016, now Pat. No. 9,822,569.

(51) Int. Cl.
*E05F 1/10* (2006.01)
*E05F 3/10* (2006.01)
*E05F 3/22* (2006.01)

(52) U.S. Cl.
CPC ..... *E05F 2003/228* (2013.01); *E05Y 2800/12* (2013.01); *E05Y 2900/132* (2013.01); *Y10T 16/281* (2015.01)

(58) Field of Classification Search
USPC ..... 16/9, 51, 53, 60, 66, 65, 49
See application file for complete search history.

(56) References Cited

U.S. PATENT DOCUMENTS 1,675,980 A * 7/1928 Lebherz ..... E05F 3/02 16/66
1,966,956 A 7/1934 Dunn
2,108,891 A * 2/1938 Johnson ..... E05F 3/16 292/275
2,958,089 A * 11/1960 Roehm ..... E05C 17/24 16/49
3,474,485 A * 10/1969 Mittig ..... E05F 3/104 16/55
3,630,560 A * 12/1971 Atkins ..... E05C 17/28 292/270
3,870,287 A * 3/1975 McMahon ..... F16F 9/0209 267/113
4,066,279 A * 1/1978 Kaptanis ..... E05F 3/02 188/288
4,083,080 A * 4/1978 Miyazawa ..... E05F 3/221 16/44
4,230,309 A * 10/1980 Schnitzius ..... F16F 9/0209 16/66
4,307,875 A * 12/1981 Schnitzius ..... F16F 9/0218 16/66
4,419,786 A 12/1983 Surko, Jr.
4,433,759 A * 2/1984 Ichinose ..... E05C 17/30 16/51
4,506,407 A 3/1985 Downey
4,513,953 A * 4/1985 Molders ..... F16F 9/0209 248/901
4,785,493 A * 11/1988 Tillmann ..... E05F 3/104 16/53
4,817,238 A * 4/1989 Liu ..... F16F 9/0218 16/58
4,837,890 A * 6/1989 Tully ..... E05C 17/28 16/71
4,847,946 A * 7/1989 Nam ..... E05F 3/102 16/53
4,858,272 A * 8/1989 Ogawa ..... E05F 3/221 16/80
4,920,609 A * 5/1990 Lin ..... E05C 17/085 16/66
5,157,806 A * 10/1992 Wartian ..... E05F 3/02 16/49
5,265,306 A * 11/1993 Yu ..... E05F 3/10 16/51
5,291,630 A * 3/1994 Brown ..... E05F 3/104 16/53
5,337,448 A * 8/1994 Brown ..... E05F 3/104 16/284
5,417,013 A * 5/1995 Tillmann ..... E05F 3/104 16/53
5,477,589 A * 12/1995 Lan ..... E05F 3/02 16/51
5,666,692 A 9/1997 Toledo
5,829,097 A 11/1998 Toledo
5,829,508 A 11/1998 DeBower et al.
5,842,255 A 12/1998 Luca
5,929,508 A 7/1999 Delgado et al.
5,956,806 A 9/1999 Tutikawa
6,138,412 A 10/2000 Rieckmann et al.
6,684,453 B2 * 2/2004 Wang ..... E05F 5/006 16/54
7,003,847 B2 * 2/2006 Brown ..... E05F 3/104 16/284
7,730,579 B2 * 6/2010 Coe ..... E05F 3/221 16/66
7,743,464 B2 * 6/2010 Tomioka ..... E05F 3/102 16/64
8,051,534 B1 * 11/2011 Luca ..... E05F 3/02 16/66
8,402,606 B1 3/2013 Tsai
8,528,169 B1 * 9/2013 Yu ..... E05D 7/043 16/51
8,578,557 B2 * 11/2013 Yu ..... E05F 3/104 16/55
8,615,846 B2 * 12/2013 Wheeler ..... E05C 17/30 16/82
8,683,653 B2 * 4/2014 Bettinzoli ..... E05F 5/02 16/286
8,806,715 B2 * 8/2014 Bienek ..... F16K 31/0627 16/53
8,875,344 B2 11/2014 Salutzki et al.
9,032,587 B2 * 5/2015 Adoline ..... F16F 9/56 16/66
9,045,926 B2 * 6/2015 Salutzki ..... E05F 3/104
9,534,435 B2 * 1/2017 Dora ..... F16F 9/3415
9,556,659 B2 * 1/2017 Fan ..... E05F 3/02
9,822,569 B2 * 11/2017 Wang ..... E05F 3/02
2002/0066157 A1 6/2002 Chen
2002/0133904 A1 9/2002 Donovan et al.
2004/0035057 A1 2/2004 Backman
2005/0125947 A1 6/2005 Kral
2008/0022490 A1 * 1/2008 Ginzel ..... E05F 15/611 16/51
2009/0139141 A1 * 6/2009 MacLeod ..... E05F 15/53 49/21
2009/0320236 A1 12/2009 Yamamuro
2010/0127606 A1 * 5/2010 Collene ..... E05F 1/1292 312/327
2010/0287729 A1 * 11/2010 Jin ..... E05F 3/12 16/52
2012/0272475 A1 * 11/2012 Bienek ..... E05F 3/104 16/51
2013/0081227 A1 4/2013 Hensh et al.
2013/0086771 A1 4/2013 Blockley
2014/0138887 A1 * 5/2014 Knobloch ..... F16F 9/512 267/126
2015/0322705 A1 11/2015 Lee et al.
2019/0338576 A1 * 11/2019 Wang ..... E05F 3/12

FOREIGN PATENT DOCUMENTS

DE 2011087695 A1 6/2013
EP 2248983 B1 8/2009
JP 2008196256 A 8/2008

* cited by examiner

PNEUMATIC DOOR CLOSER

CROSS-REFERENCE TO RELATED APPLICATIONS

This is a Divisional Application of U.S. Ser. No. 15/702,292, filed Sep. 17, 2017, which is a continuation of U.S. Ser. No. 15/211,098, filed Jul. 15, 2016, now U.S. Pat. No. 9,822,569, issued Nov. 21, 2017, which claims priority to Chinese Application No. 201610109458, filed Feb. 25, 2016, all of which are herein incorporated by reference in their entirety.

FIELD OF THE INVENTION

The present invention relates to the field of door closers, particular to a pneumatic door closer.

BACKGROUND OF THE INVENTION

People pay more attention on housing security with the social progress and technical development. A door closer is a mechanism which allows a door to close automatically. The closer usually extends between the door and door frame, and will close the door automatically under the resilient restoring force of the door closer, thereby ensuring that the door is returned to the original position accurately and timely after the door is open. The door closer provides convenience in daily life.

However, prior art door closers, such as mechanical spring door closer, usually generate a large impact force when closing the door, whereby people are easily bumped by the door because they cannot dodge or escape the closing door in a timely manner. Sometimes a big impact noise will occur when the door is closed. In addition, failure of the door closer may occur due to the instability of the spring.

In order to solve these problems, a full hydraulic door closer and an oil-air hybrid driven door closer have been developed to adjust the process of opening/closing the door according to requirements of users, while the door body and the door frame are protected effectively.

But the full hydraulic door closer and the oil-air hybrid driven door closer in the prior art have drawbacks as follows:

1. Oil leakage occurs frequently during the use, causing problems, for example, the door cannot be closed fully;

2. The speed of closing the door is controlled by oil or fluid. The biggest problem of such technology is that viscosity of the oil varies with the changes of air temperature, which will influence the flowing rate of oil, and thus the speed of closing the door. In other words, provided in the same adjustable position, the speeds of closing the door are different in winter and summer, especially for the exterior door. Accordingly, it is usually required to adjust the control apparatus of door closer, which may bother users;

3. The oil-air hybrid driven door closer is provided with a control valve in air communication with the atmosphere. The dusts mixed in the air will easily enter the oil cavity of the cylinder, causing a larger oil viscosity of hydraulic oil in the oil cavity. Thus, the speed of closing the door will be affected. Also, the service life of the oil cavity of the door closer will be shorter due to dust contamination and friction.

Therefore, a primary objective of the present invention is the provision of an improved pneumatic door closer which overcomes the problems of the prior art.

Another objective of the present invention is the provision of a pneumatic door closer having a gas chamber with a sliding piston therein, wherein gas flows within the chamber to opposite sides of the piston as the door opens and closes.

SUMMARY OF THE INVENTION

The present invention provides a pneumatic door closer, which solves the prior art problems, such as oil leakage, and varied closing speed of the door depending on viscosity of hydraulic oil, in traditional hydraulic door closers. The pneumatic door closer of the present invention can be manufactured at a low cost, and is environmentally friendly.

The present invention is implemented according to following technical solution:

A pneumatic door closer includes a rotary energy storing mechanism, which includes a housing and a driving mechanism connected thereto. The driving mechanism includes a cylinder, a second piston assembly having one end configured within the cylinder, and a sealing element sleeving on the second piston assembly. The sealing element is in an air tight connection with the cylinder and the second piston assembly, to form a closed space filled with high pressure gas in the cylinder. The second piston assembly drives the closed space into a first air chamber and a second air chamber in communication with the first air chamber. The first air chamber resides between the second piston assembly and the sealing element.

The driving mechanism also includes a first piston assembly configured in the housing, and it is connected to the other end of the second piston assembly.

The pneumatic door closer also includes a transmission mechanism having one end received in the housing and another end connected to the door frame.

When the door is opening, the transmission mechanism drives the first piston assembly to move toward the cylinder, and thus drives the second piston assembly to move away from the sealing element. The second piston squeezes the high pressure gas in the second air chamber, forcing the high pressure gas in the second air chamber to flow into the first air chamber, such that the second air chamber will become smaller.

When the external force applied on the door disappears, the second piston assembly moves toward the sealing element because the first action force is smaller than the second action force. The first air chamber will become smaller, and the high pressure gas in the first air chamber will flow into the second air chamber, to move the first piston assembly away from the cylinder, whereby the transmission mechanism is driven to close the door.

The high pressure gas in the first air chamber exerts the first action force on the second piston assembly, and the high pressure gas in the second air chamber exerts the second action force on the second piston assembly. The first action force is in a contrary or opposite direction to the second action force.

In some specific embodiments, the second piston assembly includes a push rod and a fitting component on the push rod. The fitting component resides in the closed space, and it contacts the inner wall of the cylinder to divide the closed space into two air chambers in communication with each other. The air chamber close to the sealing element is the first air chamber, and the one away from the sealing element is the second air chamber. The fitting component includes a throttle ring.

Further, the throttle ring is configured with an air inlet, an air outlet, a vent hole, and a throttle passage connecting the air outlet and the vent hole. The fitting component also includes a third sealing ring positioned between the throttle ring and the inner wall of the cylinder.

When the door is opening, a gap appears between the fitting component and the inner wall of the cylinder, whereby the high pressure gas flows from the second air chamber into the first air chamber. When the external force applied on the door disappears, the third sealing ring seals off the gap, forcing the high pressure gas to flow through the air inlet, air outlet, throttle passage, and vent hole, in turn, and into the second air chamber.

Further, the fitting component also includes a first gasket and a second gasket. The throttle ring is configured between the first gasket and the second gasket. The fitting component also includes a nut used to fasten the first and second gaskets and throttle ring to the push rod.

In some specific embodiments, a through-hole is configured in the sealing element. The second piston assembly includes a push rod and the fitting component configured thereon. The push rod extends through the through-hole to connect to the first piston assembly.

In some specific embodiments, one end of the sealing element is threaded-connected to the housing, and the other end is within the cylinder and it is in air tight sealing connection with the cylinder. First and second grooves are provided in the sealing element at another end connected to the cylinder.

Further, a first sealing ring is provided within the first groove to seal off the gap between the inner wall of the cylinder and the sealing element.

In some specific embodiments, the first piston assembly includes a piston body and a wheel configured thereon. A recess is provided on the piston body to receive the push rod.

Further, the transmission mechanism includes a cam configured within the housing and a rod connected to the cam. The cam is connected to the wheel.

In some specific embodiments, a sliding rail mechanism connected to the rod is provided at the door frame.

The technical solution of the present invention includes benefits as follows:

The pneumatic door closer of the present invention includes a cylinder configured with first and second air chambers therein. The chambers are filled with high pressure gas. The door closer further includes a transmission mechanism, a first piston assembly, and a second piston assembly in linked connection. When the door is opening, the transmission mechanism drives the first piston assembly to move, whereby the second piston assembly is driven to move to squeeze the high pressure gas in the second air chamber, forcing it to flow into the first air chamber through the gap between the fitting component and inner wall of the cylinder. When the external force applied on the door disappears, the second action force is greater than the first action force in the case that the pressures in the first and second air chamber are identical, because the forced area in the second air chamber is substantially the cross sectional area of the cylinder, and the forced area in the first air chamber is the difference area between the cross sectional areas of the cylinder and push rod. Then the second piston assembly is pushed toward the housing, and the high pressure gas in the first air chamber will flow through the throttle ring into the second air chamber, and finally making the door close slowly. The pneumatic door closer of the present invention uses pneumatic control method to avoid problems, such as oil leaks, and varied speed of closing the door depending on viscosity of hydraulic oil, in traditional hydraulic door closers. The pneumatic door closer of the present invention can be manufactured at a low cost, and is environmentally friendly.

DETAILED DESCRIPTION OF THE PREFERRED EMBODIMENTS

In order to sufficiently understand the purpose, characteristics and effect of the present invention, the concept, specific structures and technical effect of the present invention will be further described hereinafter with reference to the FIGS. 1-9.

Figure 1:
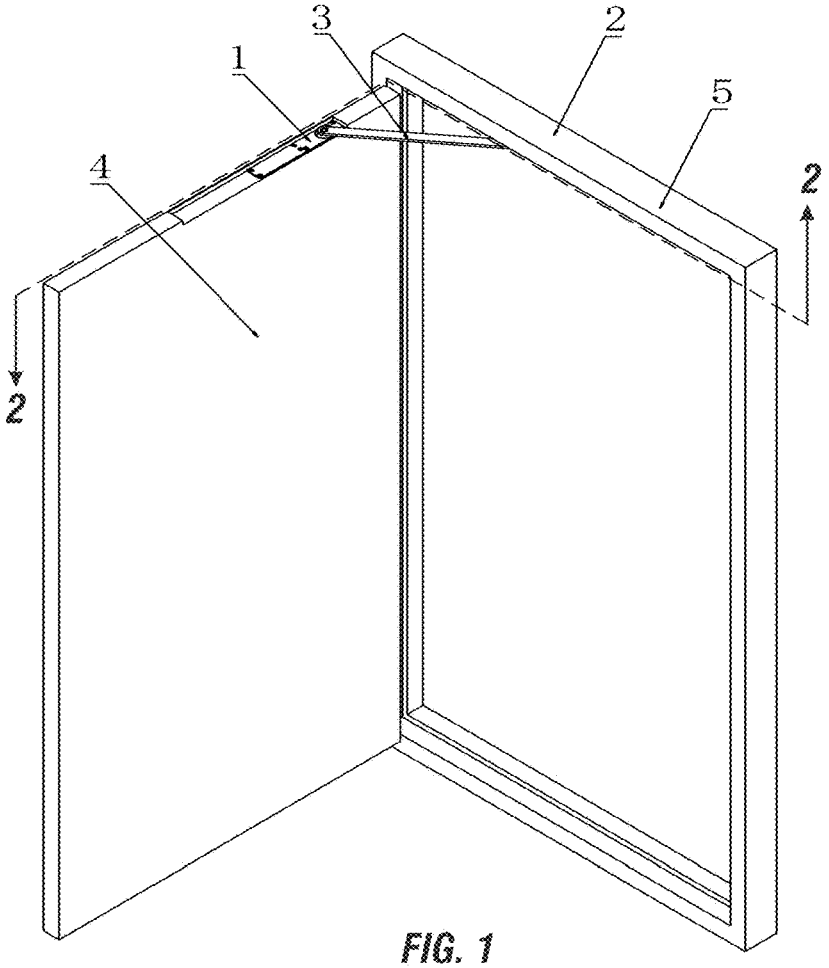
FIG. 1 is a schematic diagram illustrating a preferred embodiment of the pneumatic door closer of the present invention.

As shown in FIG. 1, the pneumatic door closer of this embodiment includes a rotary energy-storing mechanism 1, a sliding rail mechanism 2 and a transmission mechanism 3 used to connect the rotary energy-storing mechanism 1 to the sliding rail or track mechanism 2. In FIG. 1, the rotary energy-storing mechanism 1 is mounted at the top of a door 4, and the sliding rail mechanism 2 is mounted at the top of a door frame 5, though these mechanisms can also be mounted at the bottom of the door and the door frame.

Figure 2:
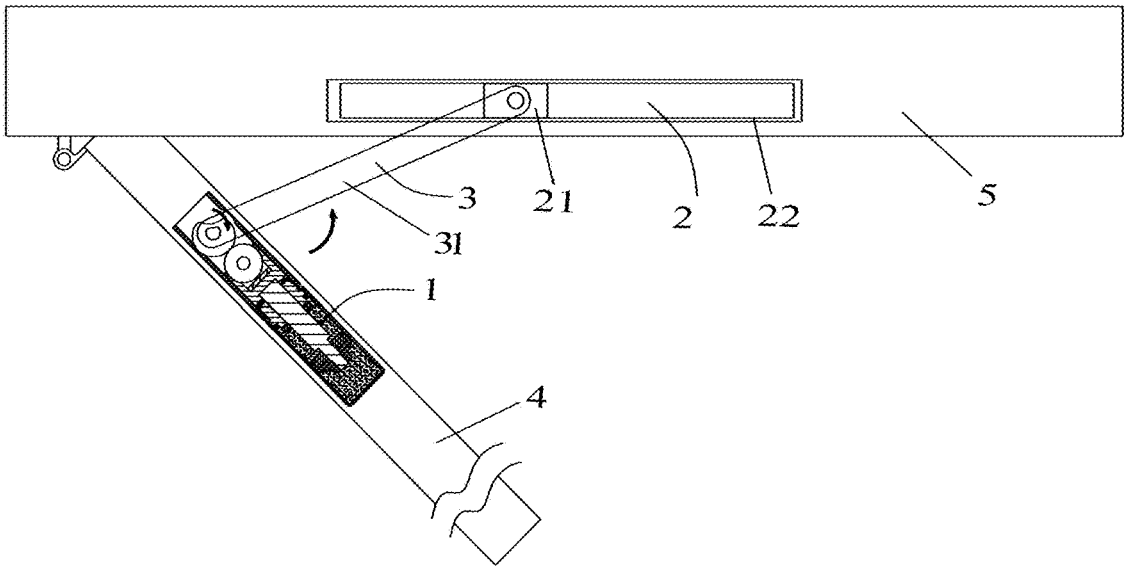
FIG. 2 is a partial sectional schematic diagram of the pneumatic door closer of the embodiment.

FIG. 2 illustrates the installing structure of the pneumatic door closer according to this embodiment. The sliding rail mechanism 2 includes a sliding rail 22 mounted in the door frame 5 and a slider 21 configured on the sliding rail 22. The transmission mechanism 3 includes a rod 31 having one end connected to the slider 21 and the other end connected to the rotary energy-storing mechanism 1.

When the door 4 is opening, the transmission mechanism 3 is driven to move under the movement of door 4, the slider 21 is thereby driven by the rod 31 to slide along the sliding rail 22, and meanwhile the rotary energy-storing mechanism 1 is driven by the transmission mechanism 3, in order to store energy.

When the external force applied on the door 4 disappears, the energy stored in the rotary energy-storing mechanism 1 releases to move the transmission mechanism 3, whereby the rod 31 moves, and it drives the slider 21 to slide along the sliding rail 22, then the door 4 will be closed.

It should be understood that it is just a preferable embodiment to arrange the rotary energy-storing mechanism 1 on the tops of the door 4 and the door frame 5 in the present invention, and that this arrangement is not a restriction for the position of pneumatic door closer of the present invention.

As shown in FIGS. 3 to 8, the rotary energy-storing mechanism 1 includes a housing 100 and a driving mechanism 200 connected thereto.

The driving mechanism 200 includes a cylinder 210, a first piston assembly 220, a second piston assembly 230, and a sealing element 240.

The first piston assembly 220 is mounted within the housing 100. The first piston assembly 220 includes a piston body 221 and a wheel 222 thereon. A recess is provided on the piston body 221 to receive a push rod 231 of the second piston assembly 230.

One end of the second piston assembly 230 is mounted within the cylinder 210, and the other end engages the first piston assembly 220. The sealing element 240 sleeves on the second piston assembly 230 and is in an air tight sealing connection with the cylinder 210 and the second piston assembly 230, to form a closed space filled with high pressure gas 250 in the cylinder 210. High pressure nitrogen is preferably used therein. It is understood that the high pressure gas includes, but is not limited to, high pressure nitrogen. The second piston assembly 230 divides the closed space into a first air chamber 260 and a second air chamber 270 in communication with each other. The first air chamber 260 is located between the second piston assembly 230 and the sealing element 240.

Specifically, the second piston assembly 230 includes the push rod 231 and a fitting component 232 configured thereon. The fitting component 232 resides within the closed space and contacts the inner wall of the cylinder 210 to divide the closed space into the two air chambers, i.e. the first air chamber 260 and the second air chamber 270, in communication with each other. The first air chamber 260 is adjacent to the sealing element 240, and the second air chamber 270 is spaced away from the sealing element 240.

The fitting component 232 includes a first gasket 2322, a second gasket 2323, a throttle ring 2321 between the gaskets 2322 and 2323, a nut 2324 used to fasten the first and second gaskets and the throttle ring to the push rod 231, and a third sealing ring 2325 configured between the throttle ring and inner wall of the cylinder.

Figure 7:
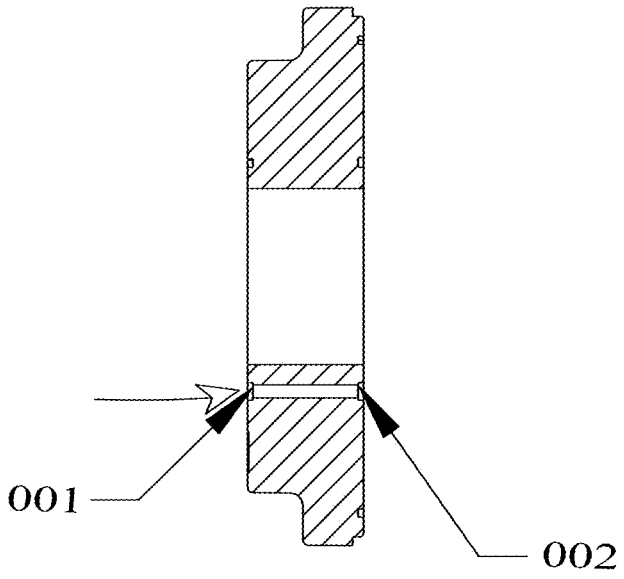
FIG. 7 is a sectional view of the throttle ring of the embodiment.
Figure 8:
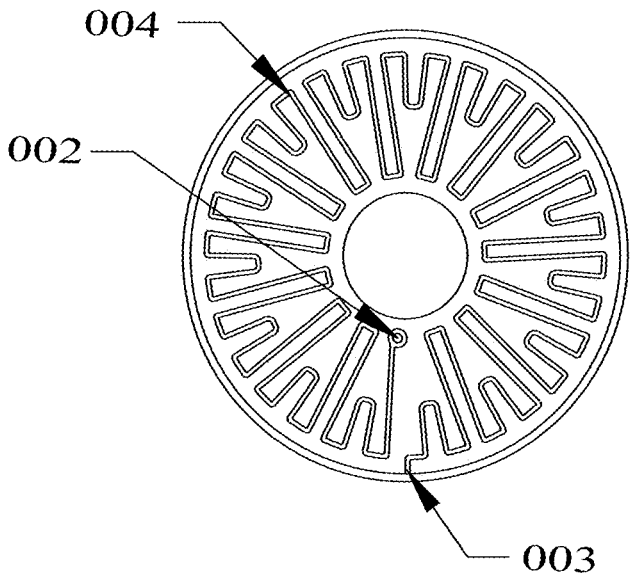
FIG. 8 is a schematic diagram of the throttle ring of the embodiment.
Figure 9:
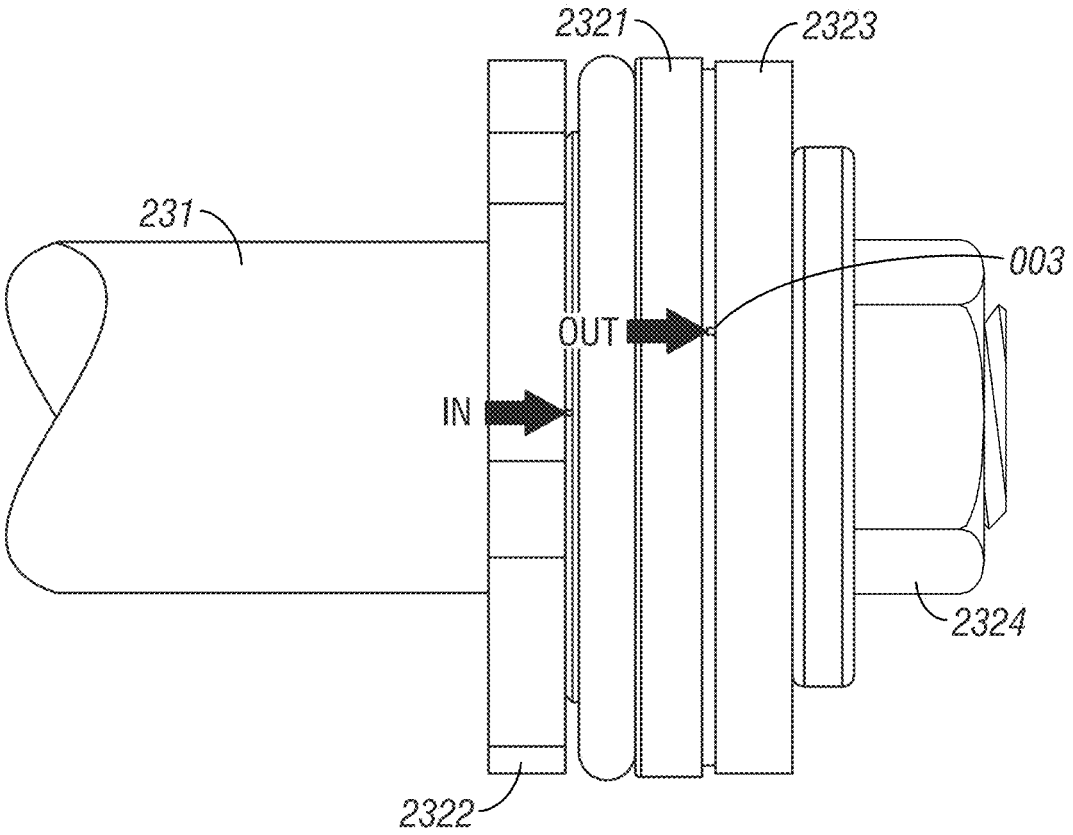
FIG. 9 is a schematic diagram showing the throttle ring and gaskets of the embodiment.

As shown in FIGS. 7-9, the throttle 2321 includes an air inlet 001, an air outlet 002, a vent hole 003, and a throttle passage 004 connecting the air outlet 002 and the vent hole 003.

Figure 5:
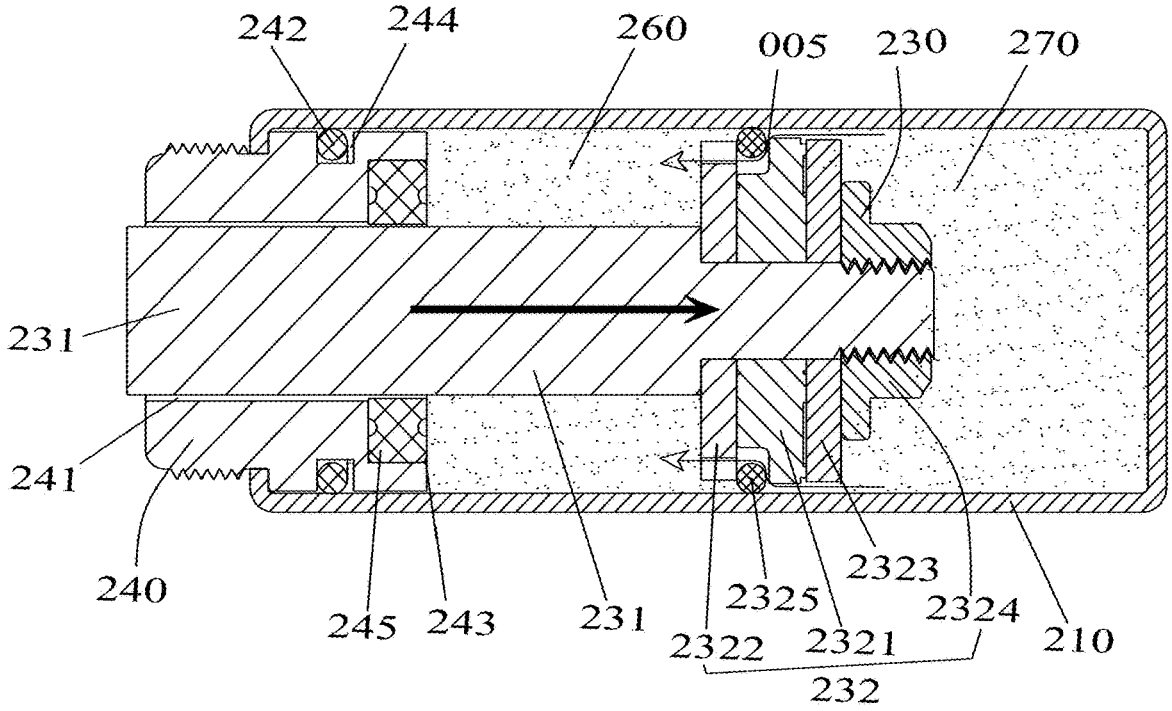
FIG. 5 is an enlarged sectional diagram illustrating the structural connection of the sealing element, the second piston assembly, and cylinder shown in FIG. 3.
Figure 6:
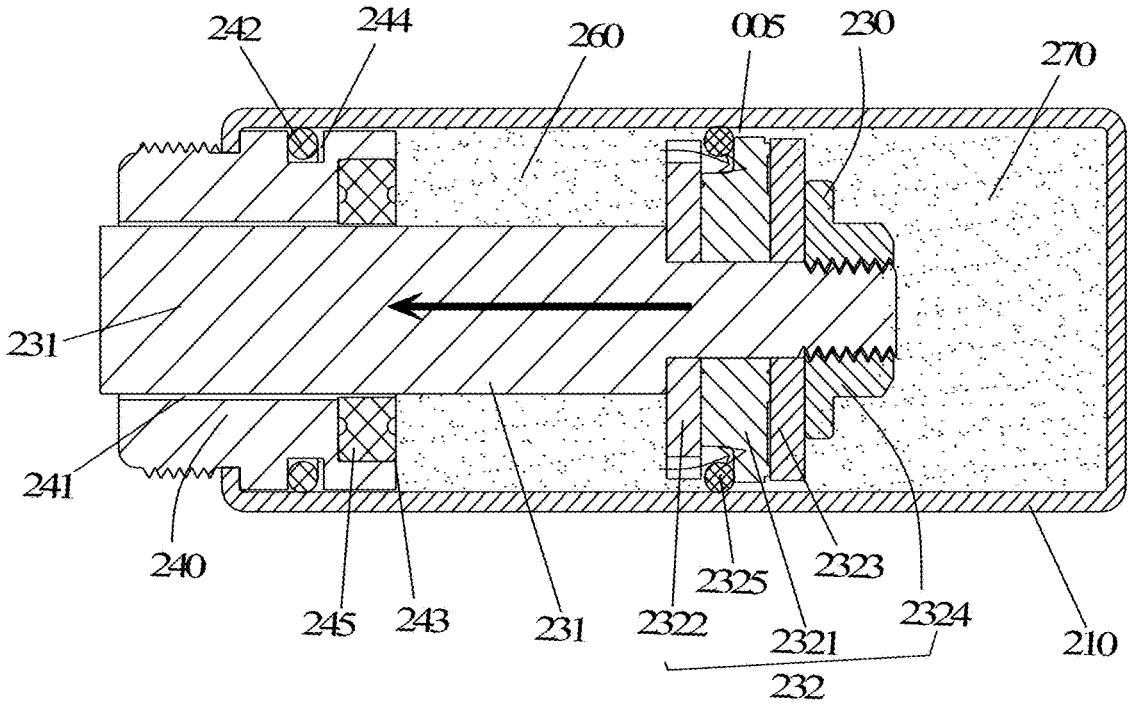
FIG. 6 is an enlarged sectional diagram illustrating the structural connection of the sealing element, the second piston assembly and cylinder shown in FIG. 4.

As shown in FIGS. 5 and 6, when the door is opening, a gap 005 appears between the fitting component 232 and the inner wall of the cylinder 210, such that the high pressure gas 250 flows from the second air chamber 270 into the first air chamber 260 in the direction indicated by the arrows in FIG. 5.

When the external force applied on the door 4 disappears, the third sealing ring 2325 seals off the gap 005, such that the high pressure gas 250 in the first air chamber 260 flows through the air inlet 001, the air outlet 002, the throttle passage 004, and the vent hole 003, in turn, and into the second air chamber 270, in the direction indicated by the arrows in FIG. 6.

The labyrinth path created by passages 001-004 slows down flow of gas from the second chamber 270 to the first chamber 260 to dampen the closing speed of the door 4.

A through-hole 241 is provided in the sealing element 240, and the push rod 230 extends through the through-hole 241 to position the end of the push rod 230 in the recess of the first piston assembly 220. One end of the sealing element 240 is threaded-connected to the housing 100, and the other end is configured within the cylinder 210 and is in air tight sealing connection with the cylinder 210.

Specifically, one end of the sealing element 240 connected to the housing 100 is provided with thread, and the housing 100 is also provided with thread in corresponding position. A first perimeter groove 242 and a second end groove 243 are provided in the sealing element 240.

Preferably, a first sealing ring 244 is configured within the first perimeter groove 242 to seal off the gap between the inner wall of the cylinder 210 and the sealing element 240. A second sealing ring 245 is configured within the second end groove 243 to seal off the gap between the push rob 231 and the sealing element 240.

The transmission mechanism 3 also includes a cam 32 configured within the housing 100, and the rod 31 connected to the cam 32. The cam 32 is connected to the first piston assembly 220.

Figure 3:
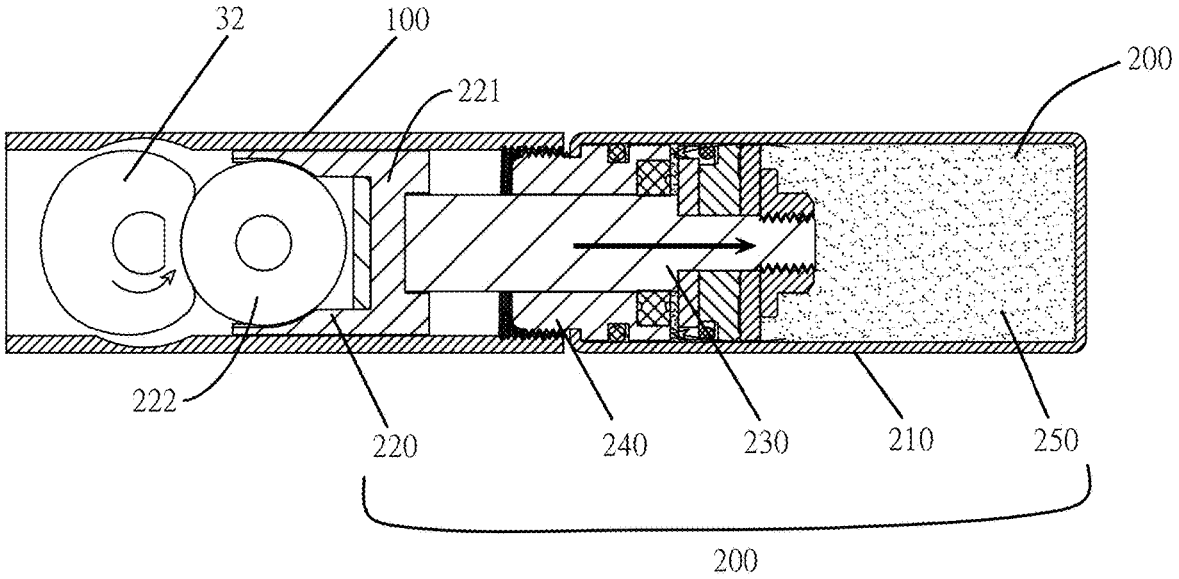
FIG. 3 is a sectional diagram of a rotary energy-storing mechanism of the embodiment when the door is opening.

FIG. 3 is a structural schematic diagram of the rotary energy-storing mechanism according to the embodiment when the door is opening. When the door 4 is opening under external force, the transmission mechanism 3 drives the first piston assembly 220 to move toward the cylinder 210, then the second piston assembly 230 moves away from the sealing element 240 to squeeze the high pressure gas 250 in the second air chamber 270, whereby the high pressure gas 250 in the second air chamber 270 flows through the gap 005 into the first air chamber 260, and the second air chamber 270 decreases in size.

Specifically, when the door is opening under an external force, the slider 21 slides along the sliding rail 22, the rod 31 rotates the cam 32 to push the first piston assembly 220 to move toward the cylinder 210, whereby the first piston assembly pushes the second piston assembly 230 to move away from the sealing element 240, the fitting component 232 squeezes the high pressure nitrogen in the second air chamber 270, and force the high pressure nitrogen to flow into the first air chamber 266 through the 005 gap between the fitting component 232 and the inner wall of the cylinder 210, then the door 4 will be open finally.

Figure 4:
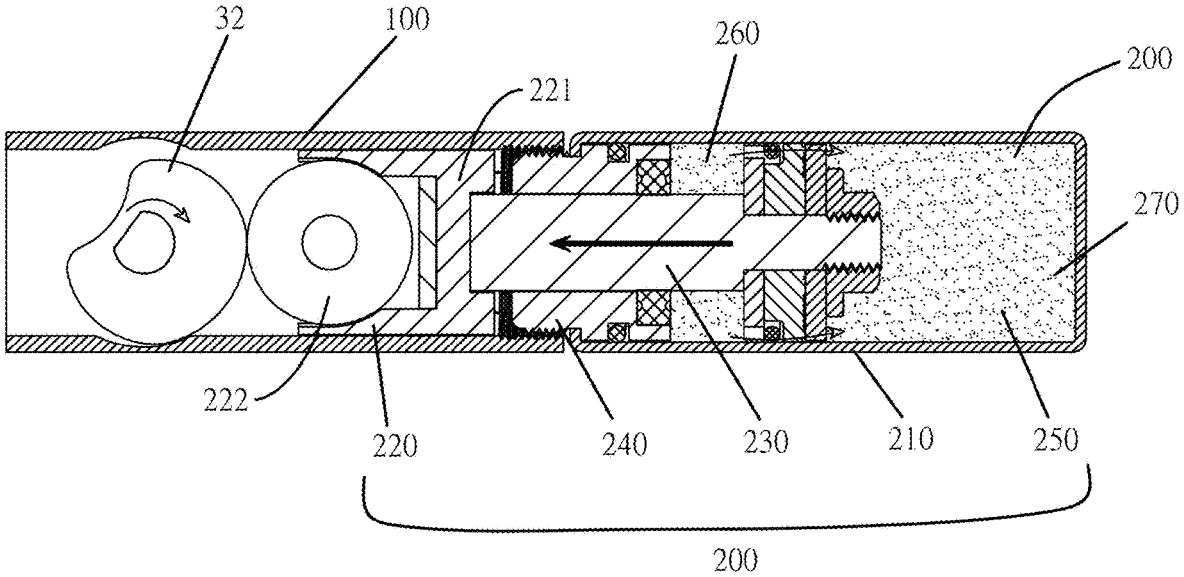
FIG. 4 is a sectional diagram of a rotary energy-storing mechanism of the embodiment when the door is closing.

FIG. 4 is a structural schematic diagram of the rotary energy-storing mechanism according to the embodiment when the door is closing. When the external force applied on the door disappears, the high pressure gas 250 in the first air chamber 260 and the second chamber 270 will act on both sides of the second piston assembly 230 respectively in contrary direction. The high pressure gas in the first air chamber 260 exerts a first action force on the second piston assembly 230, and the high pressure gas in the second air chamber 270 exerts a second action force on the second piston assembly 232. The forced area in the second air chamber 270 is substantially the cross sectional area of the cylinder 210, but the forced area in the first air chamber 260 is the difference area between the cross sectional areas of the cylinder 210 and push rod 231. Considering the pressures in the first and second air chamber are identical, the second action force is greater than the first action force, so the second piston assembly 230 will move toward the sealing element 240, making the first air chamber 260 decrease in size. Meanwhile, the high pressure gas in the first air chamber 260 will flow through passages 001-004 of the throttle ring 2321 into the second air chamber 270. Specifically, the high pressure gas in the first air chamber 260 flows into the second air chamber 270 through the throttle ring 2321, driving the first piston assembly 220 to move away from the cylinder 210, bringing the transmission mechanism 3 to move and the door closes slowly, avoiding big impact force and noise of the traditional door closer.

The pneumatic door closer of the present invention applies an air pressure control mode to avoid problems in the prior art, such as oil leak and varied speed of closing the door depending on viscosity of hydraulic oil in traditional hydraulic door closer. In addition, the pneumatic door closer of the present invention can be manufactured in low cost and is environmentally friendly.

The embodiment described hereinbefore is merely preferred embodiment of the present invention and not for purposes of any restrictions or limitations on the invention. It will be apparent that any non-substantive, obvious alterations or improvement by the technician of this technical field according to the present invention may be incorporated into ambit of claims of the present invention.

What is claimed is:

1. A method of dampening closing movement of a door pivotally mounted in a door frame, comprising:

mounting a housing on the door;

connecting a pneumatic cylinder to the housing, the pneumatic cylinder having first and second gas chambers with first and second gas passages between the first and second gas chambers;

connecting a rod to the housing and to a track in the door frame;

connecting a cam on one end of the rod in the housing;

providing a first piston in the housing, the first piston engaging the cam;

providing a second piston in the pneumatic cylinder between the first and second gas chambers;

the rod rotating the cam when the door is opening, so as to move the first piston in a first direction, which in turn moves the second piston in the first direction so as to open the first gas passage between the first and second gas chambers, whereby gas flows from the second gas chamber to the first gas chamber; and wherein when the door is closing, the first passage is closed and gas flows from the first gas chamber to the second gas chamber through the second gas passage.

2. The method of claim 1 wherein the second piston seals the first passage when the door is closing and opens the first passage when the door is opening.

3. The method of claim 1 wherein the second passage includes a labyrinthine path.

4. The method of claim 1 wherein the first and second passages allow air flow in opposite directions between the first and second gas chambers.

5. The method of claim 1 further providing a labyrinthine path in the piston to reduce flow of gas from the first gas chamber to the second gas chamber when the door is closing.

6. The method of claim 1 wherein the second piston is slidably mounted in the pneumatic cylinder.

7. The method of claim 1 wherein the first and second pistons are co-axial with one another.

8. The method of claim 1 wherein the second piston includes a throttle, and the second passage is formed in the throttle.

9. The method of claim 8 wherein the throttle includes a labyrinthine gas path with an inlet and an outlet.

10. The method of claim 1 wherein movement of the second piston inversely varies the volumes of the first and second chambers.

* * * * *